United States Patent [19]

Vecchi

[11] Patent Number: 5,037,150

[45] Date of Patent: Aug. 6, 1991

[54] GOLF BALL AND TEE HANDLING APPARATUS

[75] Inventor: John C. Vecchi, Natrona Heights, Pa.

[73] Assignee: J. V. Manufacturing Co., Inc., Natrona Heights, Pa.

[21] Appl. No.: 322,409

[22] Filed: Mar. 13, 1989

[51] Int. Cl.[5] ..... A63B 47/02

[52] U.S. Cl. ..... 294/19.2; 294/24

[58] Field of Search ..... 294/19.2, 24, 99.1; 81/53.11; 273/32 D, 32 F, 162 E, 162 F

[56] References Cited

U.S. PATENT DOCUMENTS

| | | | |
|---|---|---|---|
| 1,175,035 | 3/1916 | Wooster | 294/19.2 X |
| 1,852,956 | 4/1932 | Czichos | 294/19.2 X |
| 1,960,110 | 5/1934 | Iles | 294/19.2 X |
| 2,760,807 | 8/1956 | Watson | 294/19.2 |
| 3,312,468 | 4/1967 | Lynch | 294/99.1 X |
| 3,442,544 | 5/1969 | Faber | 294/19.2 |
| 4,021,068 | 5/1977 | Piazza | 294/19.2 |
| 4,466,650 | 8/1984 | Roedel | 294/19.2 |
| 4,846,515 | 7/1989 | Hall, Sr. | 294/19.2 |

*Primary Examiner*—Russell D. Stormer

*Attorney, Agent, or Firm*—Carothers & Carothers

[57] ABSTRACT

An apparatus for placing and retrieving golf tees and golf balls wherein both the tee and the ball are retained by different resilient members gripping the same until actuation of the apparatus to release them.

9 Claims, 2 Drawing Sheets

10
12
14
16
18
20
22
24
26
28
38
40
41
42
44
46
47
48
50
52
54
56
58
60
62
64
66
68
70
72
74
76
78
80
82
84
85
II
III
IV 14
46
48
50
52
56
58
72
74

16
28
30
32
34
36

GOLF BALL AND TEE HANDLING APPARATUS

BACKGROUND OF THE INVENTION

Golf is a game of immense popularity that is played by players at all ages and all levels of skill. Largely because of the appeal of golf to such a wide variety of players, a correspondingly wide variety of golf equipment has been conceived, including, among others devices for washing golf balls and for protecting balls and clubs and other equipment, carts for carrying clubs and bags, portable stools for the comfort of players, motorized carts for transportation of players about the course, scorekeeping devices, specialized putters and other clubs, and the like.

As golf involves repeated placement of tees and golf balls on the tees preparatory to a tee shot, and retrieval of tees and balls from the ground, various devices have also been conceived to facilitate such ball and tee placement and retrieval, such being well represented in the prior art. For example, all of the following U.S. patents disclose golf ball and/or tee handling devices: U.S. Pat. Nos. 4,466,650, 4,063,769, 4,021,068, 3,412,897, 3,318,628, 3,186,593, 2,943,856 and 2,609,198.

Although generally suited for their intended purposes, the prior art golf ball handling devices such as those disclosed in the above cited patents have exhibited certain shortcomings. Those devices which have a plurality of projecting fingers adapted to grip a golf ball at circumferentially spaced locations about the perimeter of the ball may prove to be difficult to use in that the ball is either gripped securely or completely released and unrestrained whereby actual use of these devices for precise placement of a golf ball may be quite difficult. Other known devices from among the above patents are suited only to ball retrieval and cannot be used for ball placement.

Due to these and other shortcomings of the prior art, golfers needing distance in the placement and retrieval of balls and tees have continually sought improved apparatus for the purpose.

BRIEF SUMMARY OF THE INVENTION

The present invention contemplates a novel and improved golf ball and tee placement and retrieval apparatus which overcomes the above noted and other shortcomings of the art. Specifically, the invention contemplates a ball and tee placement and retrieval apparatus which is capable and retaining both a ball and a tee by separate resilient or biased means for improved ease of handling the balls and tees, respectively.

More specifically, the invention contemplates a golf ball placement apparatus wherein a ball is retained by a resilient means which continuously encompasses the circumference of a golf ball, and a selectively actuated plunger which is movable into engagement with the ball to release it from the resilient retention means. Upon such release, however, the ball remains confined within a circumferentially extending means which confines the ball but does not exert any resilient bias to retain the ball with respect to the ball placement apparatus.

Thus, the ease of ball placement is greatly improved as a ball retained by the disclosed retention apparatus may be released for placement on a tee without relinquishing control of the ball for precise positioning and placement. As a result, release of the retained ball and positioning thereof can effectively be pursued as separate operations.

The tee retaining and placement apparatus according to my invention contemplates a spring biased clip means which is operative to retain a golf tee for inserting the shaft of the tee into the ground prior to placement of the ball thereon. The tee placement apparatus may then be manipulated by tilting thereof with respect to the tee to release the tee from it. To retrieve a tee from the ground, whether the tee is inserted in the ground and upstanding, or lying on the surface of the ground, the spring biased clip of my tee placement and retainer apparatus is pushed over the shaft of the tee to engage and grip the same. Preferably, the ball and tee placement and retrieval apparatus according to my invention are disposed at opposed ends of an elongated, hand held structure.

With the advent of my invention, one can play a round of golf without ever encountering a need to bend down to place or retrieve balls or tees. The tee may be placed in the ground preparatory to a tee shot from a standing position and after the tee shot can be retrieved from a standing position whether the tee remains upright in the ground or has been dislodged during the tee shot. Similarly, the ball may be placed on a tee from a standing position and any ball may be picked up from a standing position whether on the ground or in the hole. The invention also facilitates retrieval of a ball which cannot be played in some circumstances, such as when the ball is in a water hazard but within reach using my invention. The invention thus is of particular advantage for older or handicapped golfers, although it is equally useful as an effort saving device for any golfer.

It is accordingly one general object of the invention to provide a novel and improved golf ball and tee retrieval, retention and placement apparatus.

A more specific object of the invention is to provide a golf ball and tee handling apparatus in which the golf ball and preferably also the tee is retained by biased retention means.

A further and more specific object of the invention is to provide a golf ball handling apparatus wherein a golf ball is retained by resilient biasing means which continuously encompasses a circumferential portion of a golf ball.

Yet another object of the invention is to provide a golf tee handling apparatus wherein a golf tee is retained by spring biased clip means.

These and other objects and further advantages of the invention will be more readily appreciated upon consideration of the following detailed description and the accompanying drawings, in which.

Figure 6A:
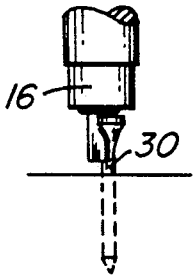

FIGS. 6A, B and C are elevational views showing operation of the tee handling structure of my invention.

Figure 1:
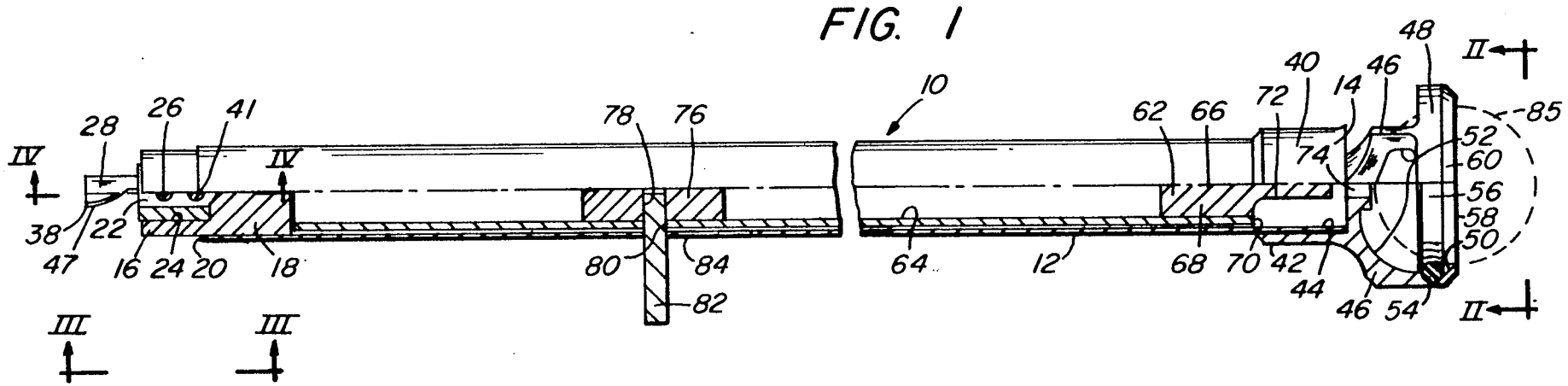
FIG. 1 is a partially sectioned side elevation of a golf ball and tee handling apparatus according to one presently preferred embodiment of the instant invention.
Figure 2:
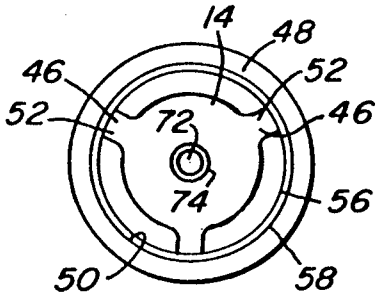
FIG. 2 is an end elevation taken on line II—II of FIG. 1.

There is generally indicated at 10 in FIG. 1 a golf ball and tee handling apparatus according to one presently preferred embodiment of the instant invention. Apparatus 10 is comprised of an elongated tubular housing 12 of aluminum tubing, for example. Housing 12 carries a ball handling structure 14 adjacent one longitudinal end thereof and a tee handling structure 16 adjacent the opposed longitudinal end thereof. The overall length of tubular housing 12 may be of any suitable dimension consistent with the needs of a golfer.

Tee handling structure 16 includes a generally cylindrical plug insert 18 which is received in interference fit coaxially within the respective open end 20 of tubular housing 12. A tee handling assembly 22 is received within an axial blind bore 24 formed in the outer end of plug 18 and is secured therein by any suitable means such as a transversely extending key or pin 26 that passes radially therethrough and is secured by interference fit within radially aligned bores 27 (FIG. 4) extending within plug insert 18. Assembly 22 includes golf tee retainer means 28 which extends axially outward from the axially outer end of plug 18 and is adapted to receive and retain a golf tee 30 as shown in FIG. 3.

Figure 3:
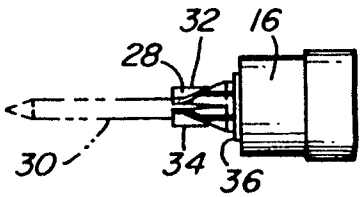
FIG. 3 is a fragmentary side elevation taken on line III—III of FIG. 1.

Tee retainer 28 includes a pair of laterally adjacent, upstanding clip elements 32 and 34 each formed with a concavity 33,35, respectively, of a size adapted to partially encompass a golf tee shaft adjacent the flared neck portion of the tee as shown in FIG. 3, and to provide an open side 38 (FIG. 1) of tee retainer 28 through which a tee may be inserted into or removed from tee retainer 28. Accordingly, the clip elements 32 and 34 are disposed such that the respective concavities 33,35 thereof are positioned in mutually confronting relationship such that a golf tee may be received therebetween.

Figure 4:
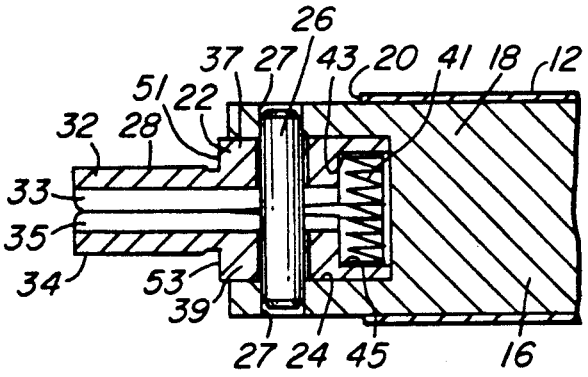
FIG. 4 is a fragmentary sectional view taken on line IV—IV of FIG. 3.
Figure 5:
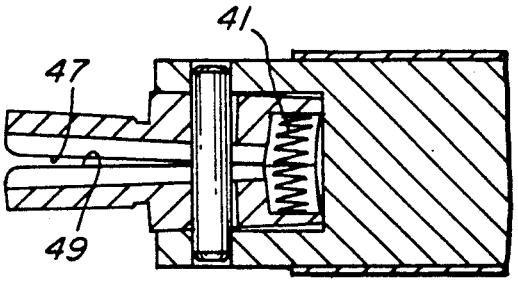
FIG. 5 is a view similar to FIG. 4.

The clip elements 32 and 34 are axially outwardly projecting portions of a respective pair of tee handling elements 37, 39 which, together with a coil spring 41, comprise the tee handling assembly 22. More specifically, elements 37 and 39 are mirror image structures assembled in confronting relationship as shown in FIG. 4 with coil spring 41 compressed sufficiently to be received within spring pockets 43 and 45 of tee handling elements 37 and 39, respectively. The elements 37 and 39 are captured on pin 26 in a loose fitting manner sufficient to permit the angular relationship of the elements 37 and 39, with respect to the center line C—C of apparatus 10, to be varied between extremes shown in FIGS. 4 and 5. To further accommodate such angular movement, mating surfaces 47 and 49 of elements 37 and 39, respectively, also are angled as shown in FIGS. 4 and 5 in a manner that the elements 37 and 39 may rotate within limits with respect to each other between the illustrated extreme positions. Accordingly, spring 41 urges the adjacent portions of elements 37 and 39 radially outward thereby biasing the tee retaining clip elements 32 and 34 together as shown in FIG. 4.

By exerting sufficient separating force upon the clip elements 32 and 34, the bias of spring 41 is readily overcome and clips 32 and 34 are moved apart to accommodate a golf tee 30 as above described. With such a golf tee 30 in place, the bias of spring 41 is effective to firmly retain the tee with its upper end engaging the outer axial end of surfaces 51, 53 of elements 37, 39 respectively.

Figure 6B:
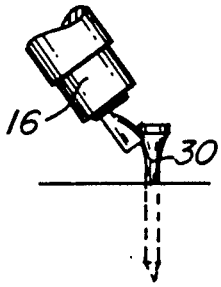
Figure 6C:
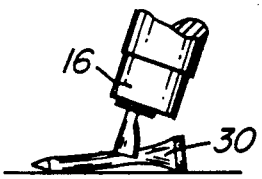

Use of tee handling structure 16 is illustrated in FIGS. 6A, B and C. A tee 30 is held by biased clip elements 32, 34 as shown in FIG. 3 and thus, by pushing downward on apparatus 10, the tee 30 may be inserted into the ground as shown in FIG. 6A. With the shaft of tee 30 inserted into the ground, tilting the apparatus 10 laterally away from the open side 38 of tee retainer 28 as shown in FIG. 6B pushes the lightly spring biased clips 32 and 34 apart and releases the tee therefrom. To retrieve a tee 30, the open side 38 of tee handling structure 16 is positioned in engagement with the shaft of a tee, preferably adjacent to the flared neck of the tee as shown in FIG. 6C, such that light pushing will separate the spring biased elements 32 and 34 to receive the tee shaft therebetween. If the tee shaft is inserted in the ground as shown in FIG. 6B, retrieval of the tee is substantially the reverse of the release operation described immediately above. If the tee is lying on the surface of the ground as shown in FIG. 6C, the tee shaft is engaged and held by the bias of the opposed sides of elements 32 and 34 in engagement therewith as shown.

For both the tee release and retrieval operations, the open side 38 of tee handling structure 16 is formed in part by rounded camming surfaces 47 which respond to the force of tee insertion or extraction to separate the spring biased elements 32 and 34 as needed to release or receive the tee, respectively.

Ball handling structure 14 preferably comprises a unitary body 40 of cast aluminum, for example, having a generally cylindrical end portion 42 in which there extends an open ended axial bore 44 that receives the respective end of tubular housing 12. Body 14 is thus retained with respect to housing 12 by any suitable means as, for example, an interference fit between bore 44 and tubular member 12. The opposed axial end of body 14 includes a plurality of axially extending leg portions 46, three legs for example, which are distributed uniformly about the longitudinal axis of body 40. A continuous circular ring element 48 is integrally disposed with respect to the outermost ends of the respective legs 46. The inner peripheral surface 50 of ring 48, as well as inner surfaces 52 of legs 46 define a confinement which is adapted to receive a golf ball 85.

For retention of such a golf ball, an inner annular groove 54 is formed on the surface 50 and receives therein a resiliently deformable ring seal 56, for example a circular cross-section O-ring. The inner diameter of ring seal 56 is of a dimension such that when a golf ball is inserted into the confinement defined by the outermost end of body 40, ring seal 56 engages the ball continuously about a peripheral portion thereof, preferably near its equatorial diameter. Ring seal 56 is resiliently deformed slightly in compression to provide for retention of the ball by biased engagement thereof continuously about the mutually engaged circumferential portions of the ball and ring seal 56.

It will be noted that groove 54 is spaced from the outermost end 58 of ring element 48 to provide a flange 60 which preferably is of a diameter just slightly larger than the equatorial diameter of a golf ball. Flange 58 and/or an inner peripheral surface portion of ring seal 56 are effective when a ball is received adjacent thereto but not retained by ring seal 56 to confine the ball for manipulation thereof by apparatus 10.

To place a ball for retention by ring seal 56, the ball is simply inserted into the open end 58 of body 40, either by pushing the ball in manually or by pushing the apparatus 10 down over a ball such as one lying on the ground, until the ball is engaged and retained by resilient deformation of seal ring 56. The ball will remain thus retained until released as follows.

For releasing a retained ball the apparatus 10 further includes a slide apparatus 62 disposed coaxially within housing 12 and slideable therein to and fro within limits. Slide apparatus 62 includes preferably a length of tubing 64, rigid plastic tubing for example, which is slideably disposed within housing 12. A generally stepped cylindrical plug element 66 has a larger diameter elongated end portion 68 thereof received coaxially within one open end 70 of the slide tube 64, and is retained therein by any suitable means such as by adhesive bonding, for example. A smaller diameter plunger end 72 of plug element 66 projects coaxially from open end 70 of slide tube 64 in coaxial alignment with the through bore 74 formed in body 40 such that plunger 72 may move through bore 74 upon axial sliding of slide tube 64.

To actuate axial sliding of tube 64, a second generally cylindrical plug member 76 is received and retained therein intermediate the longitudinal ends thereof by any suitable means such as by adhesive bonding, for example. A radially extending blind bore 78 in plug 76 is positioned in coaxial alignment with a radially extending through bore 80 in slide tube 64 to receive an actuating dowel 82 which is retained therein as by an interference fit and/or adhesive bonding. Dowel 82 extends radially outward through an elongated slot 84 formed in housing 12. Slot 84 is of a suitable axial extent to accommodate sufficient axial sliding of slide assembly 62 to move plunger 72 to and fro within bore 74. Plunger 72 thus may be selectively moved through bore 74 and into the space in which a golf ball is confined when retained by ring seal 56 as above described.

Thus, to release a golf ball from the grip of ring seal 56, actuating dowel 82 is moved downward in slot 84 thereby moving the entire slide assembly 62 downward so that the outermost axial end of plunger 72 moves through bore 74 and into engagement with the retained ball. As the retention force exerted by ring seal 56 is a very small force, the necessary force applied to dowel 82 for plunger 72 to disengage the ball from the grip of ring seal 56 is quite small and thus is easily managed.

Typically, in using the ball handling apparatus after a tee has been placed for use, the apparatus is positioned with the retained ball at the top or directly adjacent to the top of the tee. Actuating dowel 82 is then moved downward so that plunger 72 engages the ball and releases it from the retention bias of ring seal 56. The ball is then supported on the tee, but yet is also confined by the continuous circumferential extent of ring seal 56 and flange 60. The ball thus may be readily positioned with precision, and once positioned properly on the tee the apparatus 10 may be withdrawn without further disturbing the ball.

In an alternative embodiment of the invention, the apparatus may additionally include a stand-off apparatus extending longitudinally outward from ring portion 48 to support the apparatus 10 with respect to the ground while dowel 82 is actuated to release a ball onto the tee. Such additional support may be provided by, for example, three or more leg elements (not shown) extending generally longitudinally outward from ring portion 48. Such support elements will provide support for the weight of the ball retention and placement apparatus during the ball placement operation.

According to the description hereinabove, I have invented a novel and improved golf ball and tee handling apparatus of simple, economical construction and easy operation. Of course, I have contemplated other alternative and modified embodiments than those described hereinabove, and such would also surely occur to others versed in this art, once they were apprised of my invention. Accordingly, it is intended that the invention be construed broadly and limited only by the scope of the claims appended hereto.

I claim:

1. In a handling apparatus for handling a spherical object such as a game ball, the combination comprising:

An elongated member adapted to be held by a user;

A rigid ball retaining means affixed to one longitudinal end of said elongated member and including an axially extending formed member having one axial end thereof provided with a bore to receive said one longitudinal end of said elongated member, and the opposed axial end of said formed member being provided with a plurality of circumferentially distributed, axially projecting leg portions having respective axially outer ends and a rigid ring portion affixed to said axially outer ends, respectively;

said formed member including a ball confining portion with said ring portion forming an open end of said ball confining portion through which to receive such a ball at least partially therein;

a resiliently deformable, substantially circular means carried coaxially of said ring portion adjacent an inner circumferential portion thereof;

said circular means having an inner diameter of such dimension that, upon passing such a ball into said ball confining portion through said open end, said circular means engages the ball along said inner diameter and resiliently deforms in compression sufficiently to retain such a ball within said ball confining portion; and disengagement means selectively operable to project axially into said ball confining portion for moving such a ball axially outward toward said open end to a position whereat the ball is disengaged from said circular means.

2. A handling apparatus for handling golf balls and tees comprising:

an elongated generally tubular member adapted to be held by a user;

a ball handling assembly affixed adjacent one longitudinal end of said elongated member and a tee handling assembly affixed adjacent the opposed longitudinal end thereof;

said ball handling assembly including a rigid retaining member having a ball receiving portion which extends axially outward of said one longitudinal end to define an open ended ball confining cavity, and an outermost ring portion which defines an outer open end of said ball confining cavity;

a resiliently deformable means carried coaxially of said ring portion adjacent an inner circumferential portion thereof;

said resiliently deformable means having an inner surface means of such dimension that, upon placement of such a ball into said ball confining cavity through said open end, said resiliently deformable means engages the ball continuously along said inner surface means in a manner that said resiliently deformable means is resiliently deformed in compression sufficiently to retain such a ball within said ball confining cavity;

disengagement means slideably disposed within said elongated member and including a plunger means which is operable upon selective axial sliding of said disengagement means to move into and out of said ball confining cavity in a direction such that, upon selective sliding of said disengagement means to move said plunger into said ball confining cavity, said plunger engages a ball disposed within said ball confining cavity to move the ball toward said open end to a position whereat the ball is disengaged from said resiliently deformable means;

said tee handling assembly including a pair of elongated laterally adjacent clip elements extending longitudinally outward of said opposed longitudinal end and formed with respective concavities which open toward one another in confronting relationship to receive such a golf tee therebetween; and biasing means cooperable with said clip elements to continuously bias said clip elements toward one another such that the bias of said biasing means is effective to retain such a golf tee intermediate said clip elements.

3. A handling apparatus for handling golf tees comprising:

a handle means adapted to be manually grasped by a user;

a tee handling assembly affixed to said handle means;

said tee handling assembly including a pair of elongated clip elements disposed adjacent each other and adapted to receive a golf tee therebetween;

said clip elements being movably retained with respect to said handle means in a manner to be movable toward and away from each other for receiving and releasing such a golf tee therebetween; and biasing means operable to continuously bias said clip elements toward each other and to permit said clip elements to be moved away from each other only by overcoming the bias of said biasing means.

4. The apparatus as set forth in claim 3 wherein said clip elements include respective portions thereof extending within a recess formed within said handle means.

5. The apparatus as set forth in claim 4 wherein said portions of said clip elements are retained with respect to said handle means by transverse pin means extending within mutually aligned generally radial bores formed in said portions of said clip means and corresponding portions of said handle means encompassing said recess.

6. The apparatus as set forth in claim 5 wherein said biasing means is a spring means engaged between said portions of said clip elements within said recess.

7. The apparatus as set forth in claim 6 wherein the longitudinally outermost ends of said clip means and said spring means are disposed in longitudinally opposed directions from said pin means such that movement of said clip elements away from each other to overcome the bias of said spring means is achieved by rotation of said clip elements in opposed directions, respectively, about said pin means.

8. The apparatus as set forth in claim 3 wherein each of said clip elements includes a respective concavity which opens toward the respective concavity of the other clip element in confronting relationship therewith to receive a golf tee.

9. The apparatus as set forth in claim 8 wherein said clip elements additionally include camming surface means which are operable upon engagement with a golf tee to move said clip elements away from each other.

* * * * *